US005813154A

United States Patent [19]

Wilford

[11] Patent Number: 5,813,154

[45] Date of Patent: Sep. 29, 1998

[54] MAGNETIC DISPLAY FORMAT SYSTEM FOR ACCOMODATION OF ALPHANUMERIC CHARACTER WIDTH DIFFERENCE

[76] Inventor: Wesley Ralph Wilford, P.O. Box 1965, Brentwood, Tenn. 37024-1965

[21] Appl. No.: 771,068

[22] Filed: Dec. 20, 1996

[51] Int. Cl.[6] ..... G09F 7/02

[52] U.S. Cl. ..... 40/618; 40/621; 273/157 R; 434/168

[58] Field of Search ..... 40/618, 620, 621; 434/159, 168, 171, 406; 446/85, 92; 273/156, 157 R, 239

[56] References Cited

U.S. PATENT DOCUMENTS

| | | | |
|---|---|---|---|
| 2,923,551 | 2/1960 | Pope | 273/157 R |
| 3,302,310 | 2/1967 | Leven | 434/171 |
| 4,830,376 | 5/1989 | Hillis | 273/157 R |
| 5,337,501 | 8/1994 | Amanze | 40/621 |
| 5,575,658 | 11/1996 | Barnard | 434/406 X |

FOREIGN PATENT DOCUMENTS

| | | | |
|---|---|---|---|
| 197004 | 7/1938 | Switzerland | 434/171 |
| 2178215 | 2/1987 | United Kingdom | 434/171 |

*Primary Examiner*—Brian K. Green
*Attorney, Agent, or Firm*—Waddey & Patterson; I. C. Waddey, Jr.

[57] ABSTRACT

A changeable magnetic sign kit including; interlocking pieces, upon which are imprinted alphanumeric characters, which can be reconstructed into different messages, and which vary in width to accomodate the variety of widths of characters within a font style, the width dimension of each character piece having a specific mathematical relationship with the width dimension of another; similar interlocking framepieces which connect with the alphanumeric imprinted pieces to connect them with a straight edged perimeter, and connector pieces which interlock with either the framepieces or the character pieces to join one parallelogram comprised of these two type pieces to another parallelogram comprised of these two type pieces to another parallelogram comprised of these two type pieces.

15 Claims, 8 Drawing Sheets

MAGNETIC DISPLAY FORMAT SYSTEM FOR ACCOMODATION OF ALPHANUMERIC CHARACTER WIDTH DIFFERENCE

BACKGROUND INFORMATION

There have been advances in the design of changeable, low cost signs and display formats. It is advantageous for businesses to display information which will ultimately serve the interests of the business. To a similar degree, an individual's interests in dissememinating information to others has been served by various modes of expression and display. Individual's have used bumper stickers on cars, lapel pins, T-shirts, personalized license plates, etc. to get their message to others.

This invention incorporates the reduction in cost of magnetic sheeting with the individual's desirement to say their messages.

A similar attempt to design a workable, low cost display format incorporating the arrangement of pieces affixed with alphanumeric characters and secured to some surface of application with magnetics has been attempted by Amanze, U.S. Pat. #5,337,501. The interlocking nature of the zig-zag configuration described by Amanze is 'interlocking' only to the extent that there is a stabilizing force between each magnetic character and some functionable surface of application which secures one piece abutted to the border of a contiguous piece.

The present invention improves on this interlocking ability by employing a system of jigsaw puzzle type tabs and endentations. The snug 'no escape' configuration of pieces within the present invention's system (without removing some piece from the plane of interlockability) is an improvement over the 'contiguous border' character of Amanze's pieces. The construction of the present invention is further stabilized by the interlocking frame construction either surrounding the 'character' pieces or integrated within the system of character pieces. Further, Amanze's invention describes a 'transparent' background upon which his characters are affixed. The present invention employs an opaque background with normally a rectangular perimeter for the character piece and frame piece constructions. This format is desirable because it has been made familiar to the public as the standard format of 'bumper stickers' (typically an opaque rectangle) and it allows for a more practical construction of these character pieces which, along with the frame pieces, can be cut from a single magnetic sheet into functionable pieces which are each employable as some component of the resource grid and frame construction of the present invention.

SUMMARY OF THE INVENTION

A resource grid of alphanumeric characters or other symbols imposed on jigsaw puzzle type pieces is of a design that may be disassembled, and some select reconstruction of the pieces created by the user, is a desired word, phrase, question, or other message which can be completed into a single line or multiple line design which is most desirable with regard to both the spacing between words and letters, and also the achievement of a regular shape at the perimeter of the finished construction, typically a parallelogram. The finished construction may be displayed to convey the word, phrase, etc. contained thereon as a magnetic bumper sticker (sometimes for use in emergencies), a similar grid of refrigerator magnet pieces, or as non-magnetic, jigsaw puzzle board type pieces. The system could also be used for some intelligence exercise for children in that the construction could require correct English, spelling, and a good choice of blank interior grid pieces and frame structure pieces to fill out the grid to a regular geometric form at the perimeter.

The invention makes special accomodation for the spacing of letters within a word to be constructed.

Alphanumeric characters of a specific font style have sufficiently different width dimensions such that imprinting all letters on same sized gridpieces would result in undesirable, excess space between letters.

Consider the word 'Mix.' Some fonts which may be desired for use on the display grid have a font version of the letter 'i' which has a width dimension which is much smaller than the width dimension of of the capital letter 'M.' Connecting three, same width gridpieces imposed with these three letters of this particular font would result in a visually incorrect spacing between the M,. i, and x. A narrow font version of the i, imposed on a gridpiece large enough to accomodate a wide M will appear to be too far away from the M or x or both.

The invention solves this problem. The narrowest gridpiece of the invention will accomodate the dimensions of the narrowest alphanumeric characters of a font (i.e. the letters i and l, and possibly the letters r, t, f, and j, and symbols like a period, comma, etc.).

The largest sized gridpiece, used to accomodate the widest alphanumeric characters of the selected font will have the same height as the narrowest gridpiece, and a width that is a regular multiple of the width of the narrowest piece. If the largest gridpiece has a width that is four times the width of the narrowest gridpiece, it will also have exactly the same perimeter shape as four of the narrowest pieces, interconnected, side by side. Intermediate sized pieces also have a width dimension that is a regular multiple of the width dimension of the narrow gridpiece.

The process of reducing the width dimension of a character piece to exactly one-half, one-third, one-fourth, one-fifth, etc. the width of the widest character piece creates a manageable, regular grid system of pieces whereby a combination of alphanumeric pieces can always be connected and the width of that construction then extended to a desired specific width by attaching similar 'blank' gridpieces (no alphanumerics) so as to reach the required dimension to fill and connect with a frame structure of specific dimension. In one form of the invention these gridpieces are designed to be interconnectable with any other interior gridpiece on each of their four sides owing to a design of complimentary tabs and endentations which dovetail, and so, connect one piece snugly to another. In a second form of the invention these alphanumeric character pieces and similar 'blank' pieces ('interior grid pieces') interlock only horizontally employing the system of tabs and endentations on the left and right edges only.

DETAILED DESCRIPTION

Figure 1:
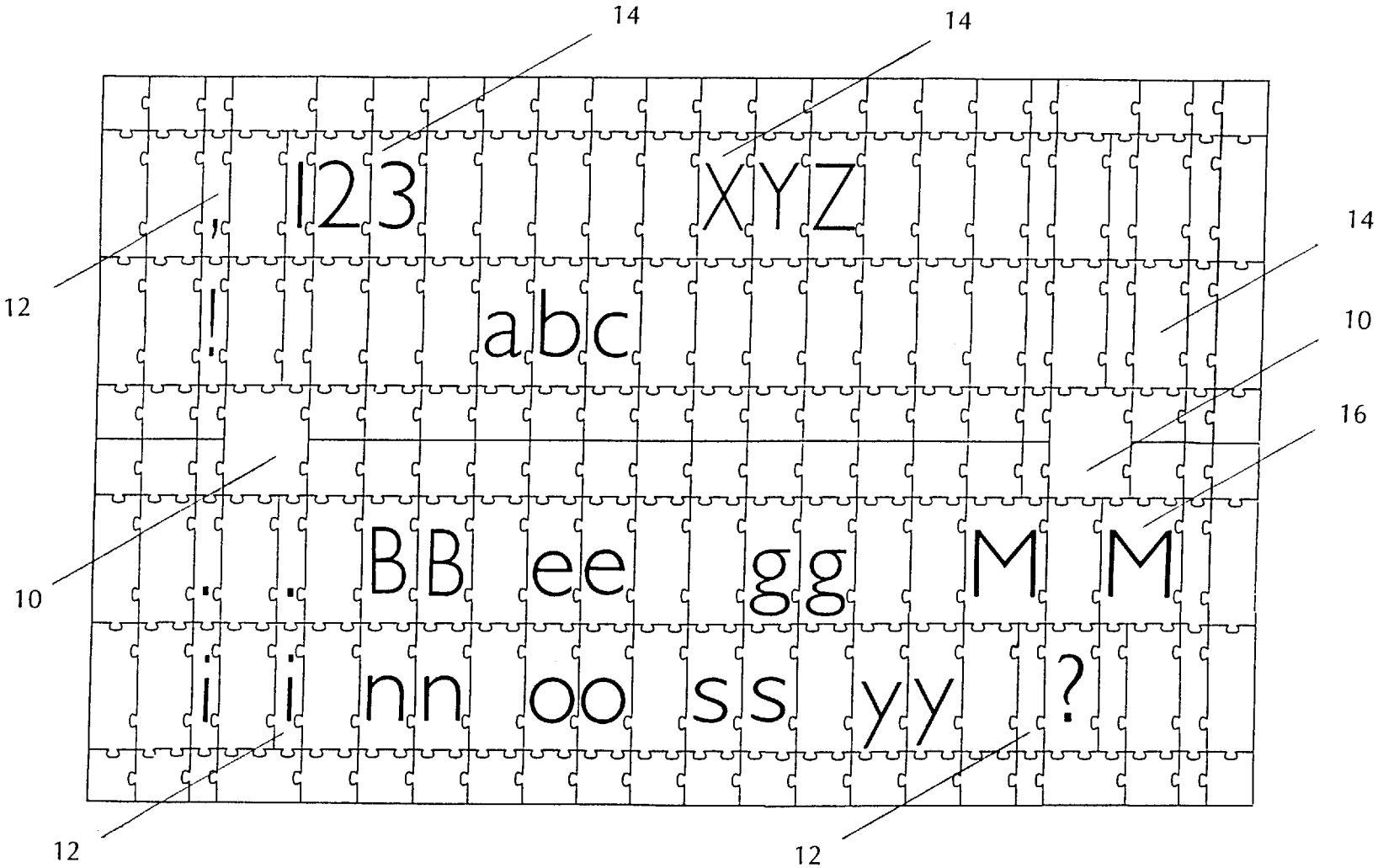
FIG. 1 is an orthogonal view of a resource grid of interlocking interior grid 'character' pieces, framepieces, and connector pieces.

FIG. 1 is one form of the invention where the interlocking grid of alphanumeric characters is shown to be structured to match the interlocking and physically supportive system of framepieces which serve to square the edges of the perimeter of the display format. Shown in FIG. 1 is a construction of two fields of 'interior grid' pieces or 'character' pieces, each surrounded by an interlocking series of framepieces. The framepieces surrounding the top two lines of interior grid pieces are connected to the second series of framepieces which surround a second two line group of interior grid pieces utilizing two connector pieces (10). The form of the invention in FIG. 1 employs a system of interior grid pieces which make the accomodation for the variation in character width by using a most narrow piece (12) of a specific dimension, and a next sized, interior grid piece (14) which is twice the width of the narrow piece shown and has the same vertical dimension as any other interior grid piece with similar intrerlocking tabs and indentations. A next sized piece (16) has a width equal to three times the width of the narrow pieces (12) and interlocks similarly with other interior grid pieces or frame pieces.

Figure 2:
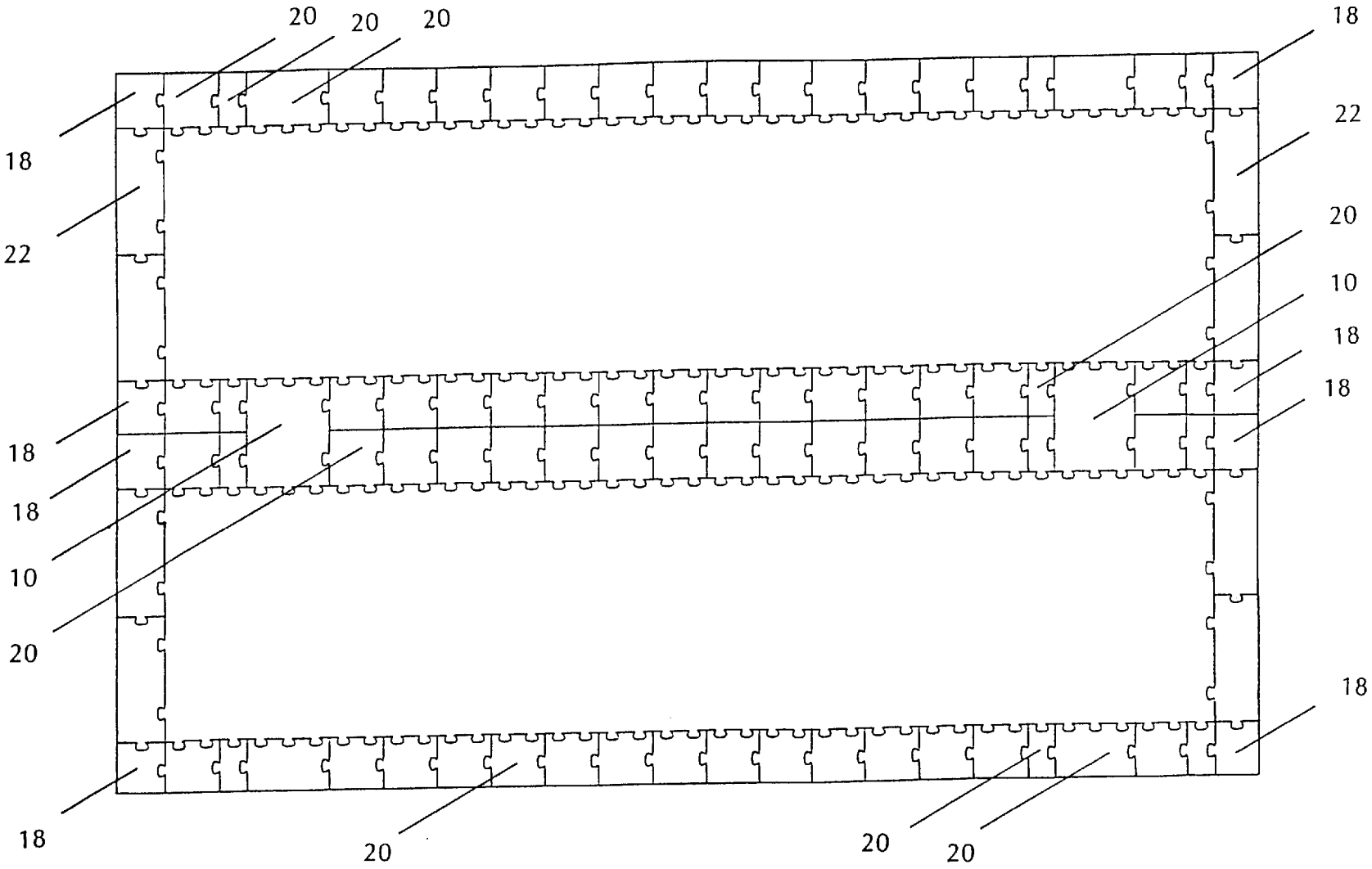
FIG. 2 is a reproduction of FIG. 1 with interior grid character pieces removed.

FIG. 2 is a reproduction of FIG. 1 without the two fields of interior grid character pieces. Shown, the remainder, is the framework structure for this example of the invention. It is comprised of connector pieces (10) and frame pieces which include 'corner' frame pieces (18) and 'single straight edge' framepieces. The corner frame pieces have two adjacent straight edges which form the corner portion of the rectangular shaped perimeter border. In order to increase the number of corner frame pieces supplied to the user so that he might complete more than one regular perimeter frame construction from the single resource grid furnished, a series of rectangular frame constructions are attached one to another (two shown) by the connector pieces (10). The connector pieces (10) have the same dimensions and the same pattern of tabs and endentations for interlocking with character pieces as two similar horizontal frame structure pieces (20) were they aligned and abutted along their straight edges. Frame pieces comprising the upper and lower horizontal framework (20) here employ a system of width dimensions similar to the width dimension system described for the interior grid characters described by FIG. 1, such that any width construction of interior grid pieces can be precisely surrounded by a construction of upper and lower horizontal frame structure pieces (20) and left and right vertical frame structure pieces (22) and/or connector pieces (10).

Figure 3:
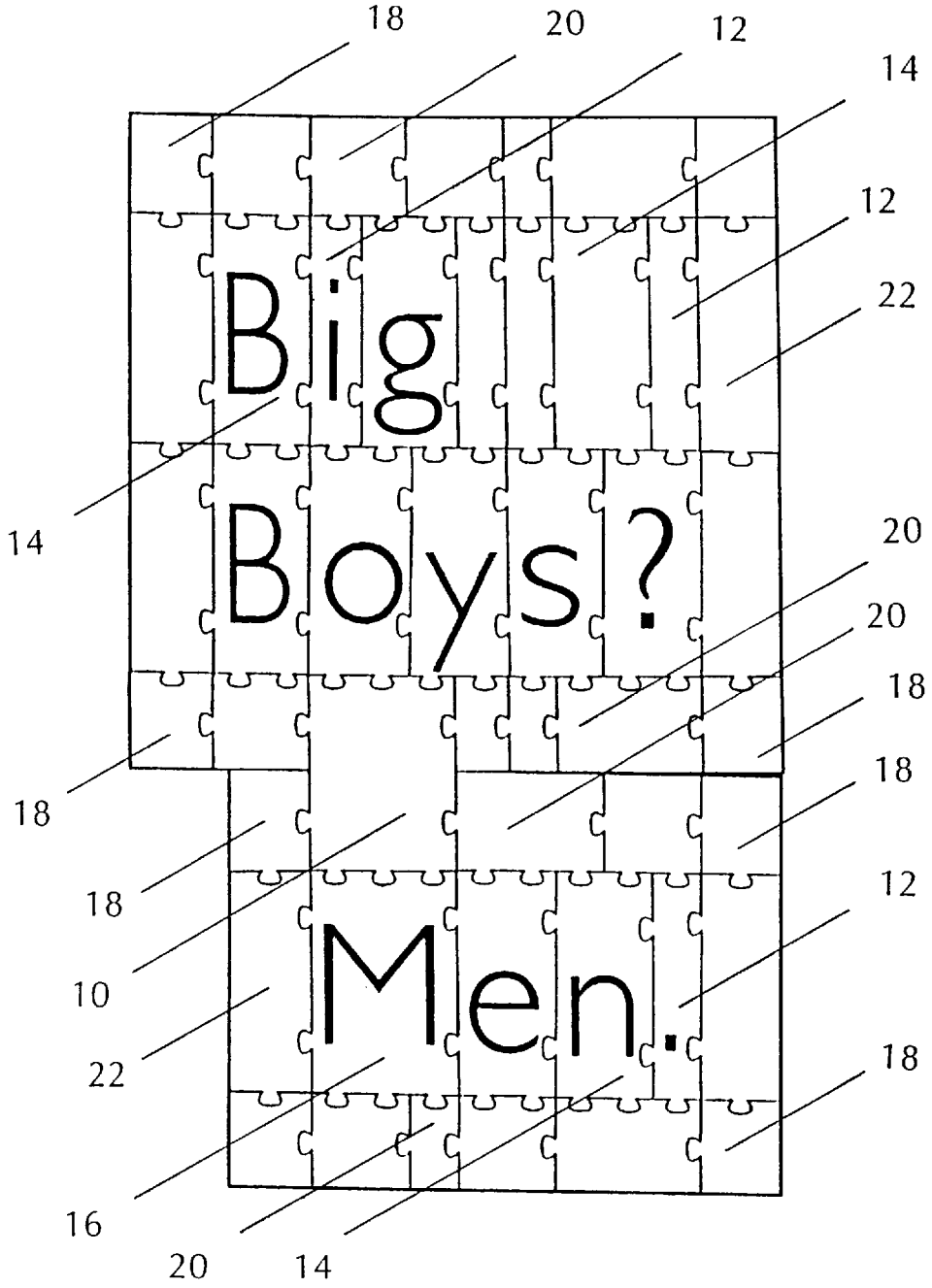
FIG. 3 is a user constructed grid of pieces from the resource grid shown in FIG. 1.

FIG. 3 is an example of a user constructed grid from the elements of the resource grid shown in FIG. 1. The user has constructed two rectangular framework structures comprised of corner frame pieces (18), left and right vertical frame pieces (22), and upper and lower horizontal frame pieces (20). The two contained fields of interior grid pieces are comprised of alphanumeric and blank pieces of the most narrow width dimension (12), of the next sized width dimension (14) and of the greatest width dimension piece of the example (16). A connnector piece (10) is substituted for a horizontal framepiece in each rectangular framework structure and owing to its design, snugly interlocks one framework construction with the second.

Figure 3A:
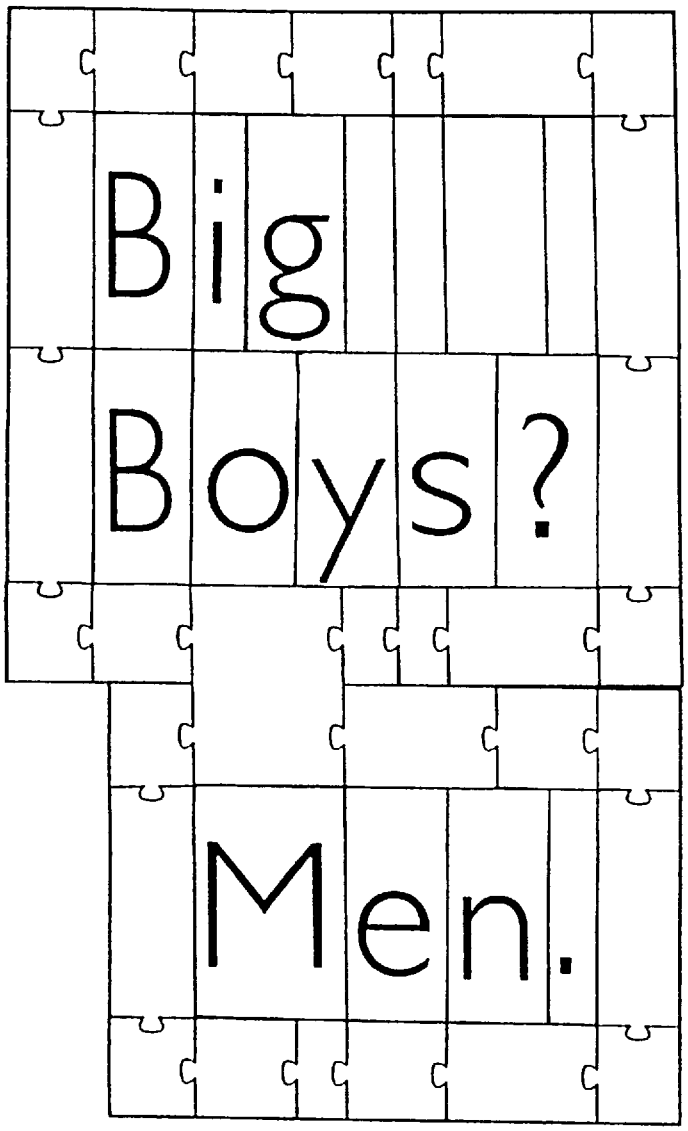
FIG. 3*a* is a user constructed grid of pieces of another form of the invention in which interior grid pieces are 'interfitted' within the framework structure.
Figure 3B:
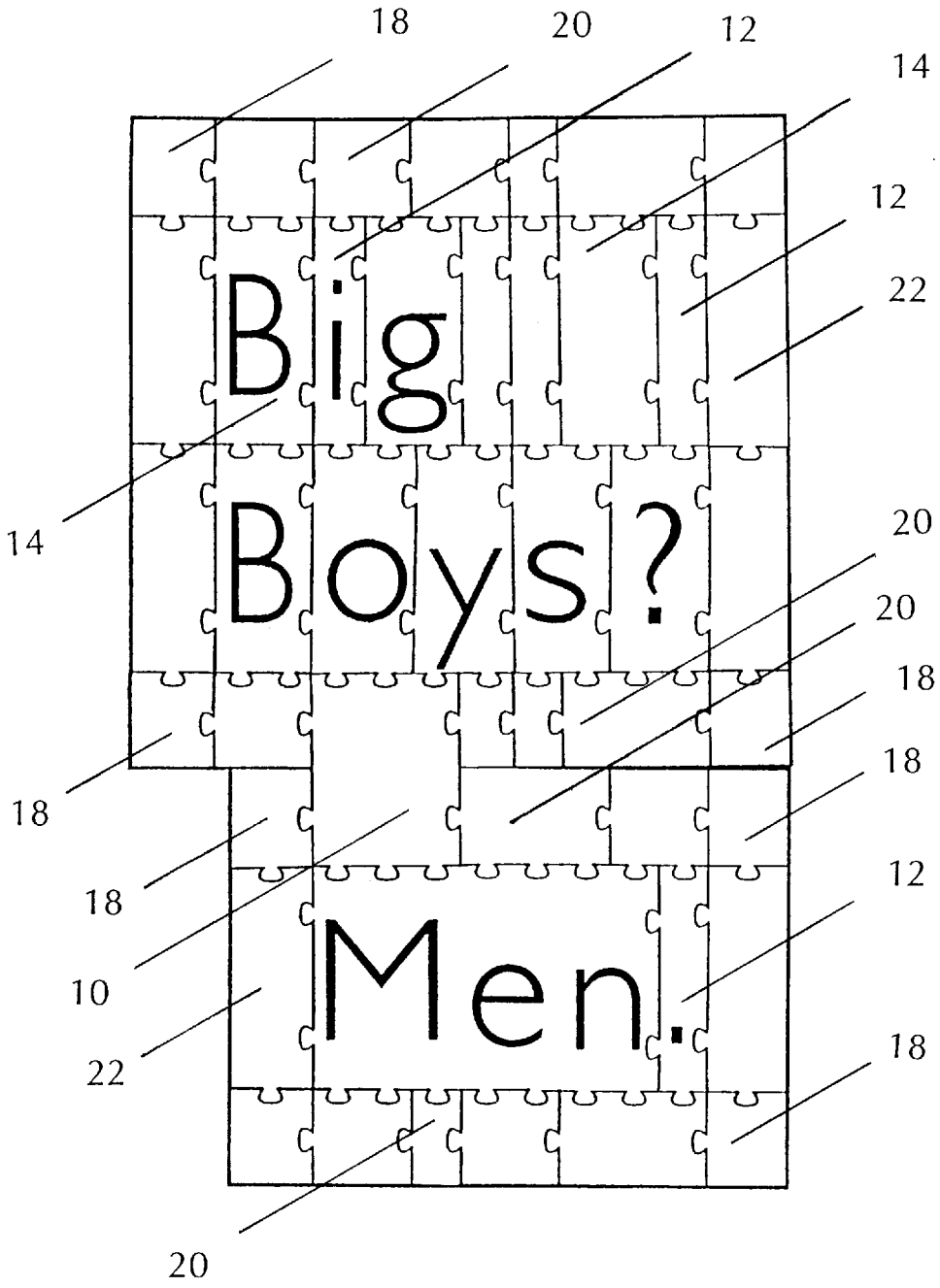
FIG. 3*b* is a user constructed grid of pieces showing the use of a grid piece imprinted with an entire word.

FIG. 3*a* is an example of a user constructed grid from the elements of a resource grid of a design similar to that of FIG. 1, but of a related form of the invention in which the mathematical relationship between the width dimensions of the alphanumeric interior grid pieces does exist to coordinate with a supporting framework structure; however, the character pieces are 'interfitted' snugly within a constructed framework rather than 'interlocking' as in the form of the invention described in FIG. 1 which employs a system of tabs and endentations on the interior grid.

Figure 4:
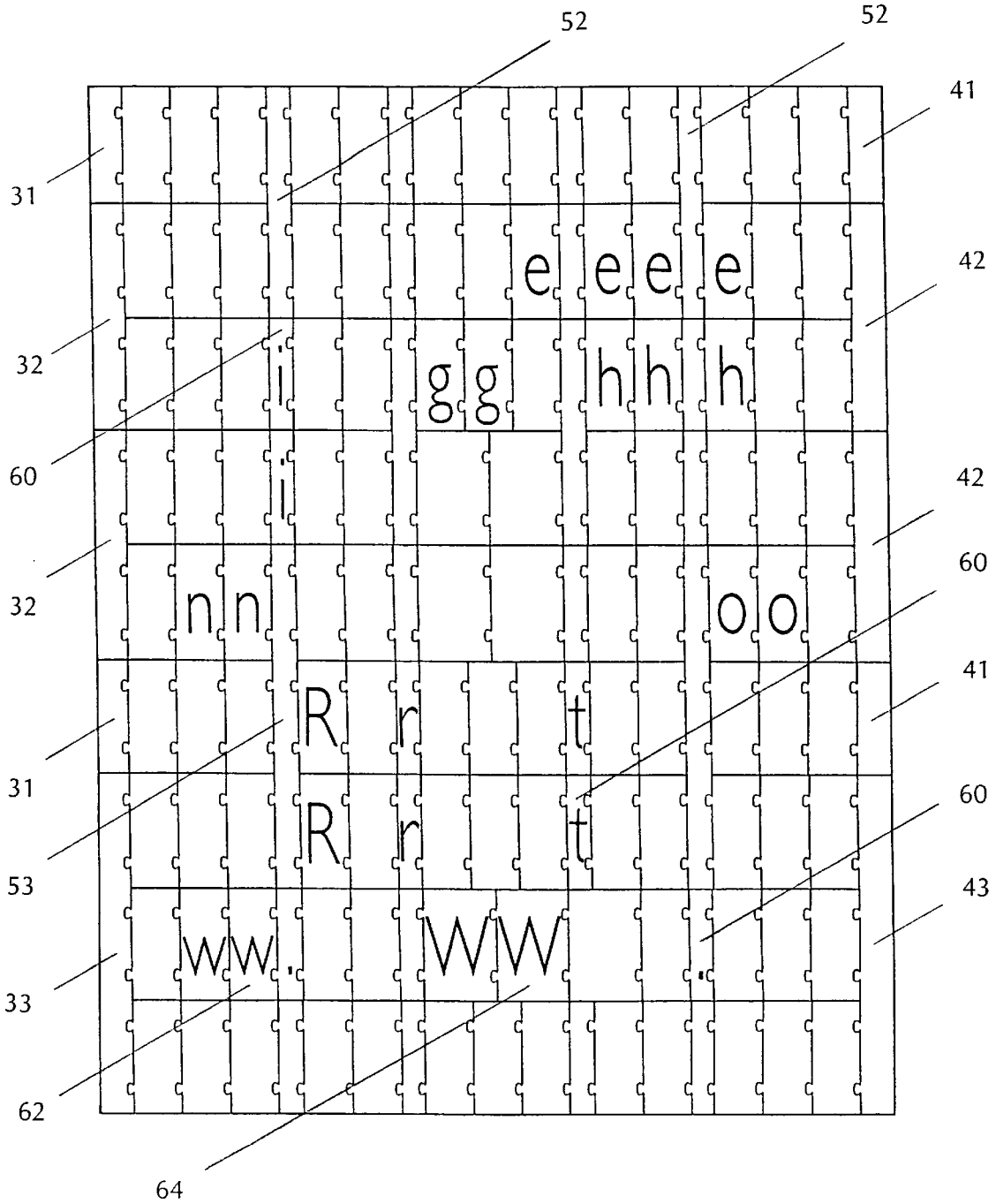
FIG. 4 is an orthogonal view of a resource grid of interlocking interior grid pieces, end pieces and connector pieces of one form of the invention.

FIG. 4 is a second form of the invention which employs endpieces at either end of a construction of the interior grid alphanumeric pieces to either connect one line to another or to simply square the perimeter edge configuration to a rectangle in the case of a single line construction, employing the attachment of one left side endpiece (31) and one right side endpiece (41). Left side endpieces (32) which connect two lines, and left side endpieces (33) which connect three lines, interlock with and square the upper and lower left corners of a construction to a rectangle. The same connecting, interlocking and squaring is achieved from the right side using two line connecting right hand endpieces (42) and three line connecting right hand endpieces (43).

Connector pieces of this form of the invention (52 and 53) physically connect one line or set of lines to another line or set of lines by interlocking within the interior grid pieces of each set of lines. The end pieces and connector pieces comprise the frame structure in this form of the invention. In this example of the invention, the connector pieces would typically be blank and would have vertical dimensions equal to some multiple of the vertical dimension of the character pieces, so as to exist exactly within the dimensions of the lines connected. Two line connector pieces (52) exist precisely within the vertical dimension of two lines of construction. Three line connector pieces (53) exist precisely within the vertical dimension of three lines.

The alphanumeric interior grid character pieces of this form of the invention make the special accomodation for spacing of characters employing the more narrow pieces (60), next sized width pieces (62), or the greatest width pieces (64); but are not interlocking on all four sides with other gridpieces. They interlock with one another only horizontally, employing the system of tabs and endentations on their left and right edges. The top and bottom edges of each of these character pieces is a straight edge. The straight edge at the left side of the left endpieces, the straight edge at the right side of the right endpieces, and the straight lines created at the top and bottom edges of a construction of character pieces comprise the desired rectangular shape at the perimeter of a construction.

Figure 5:
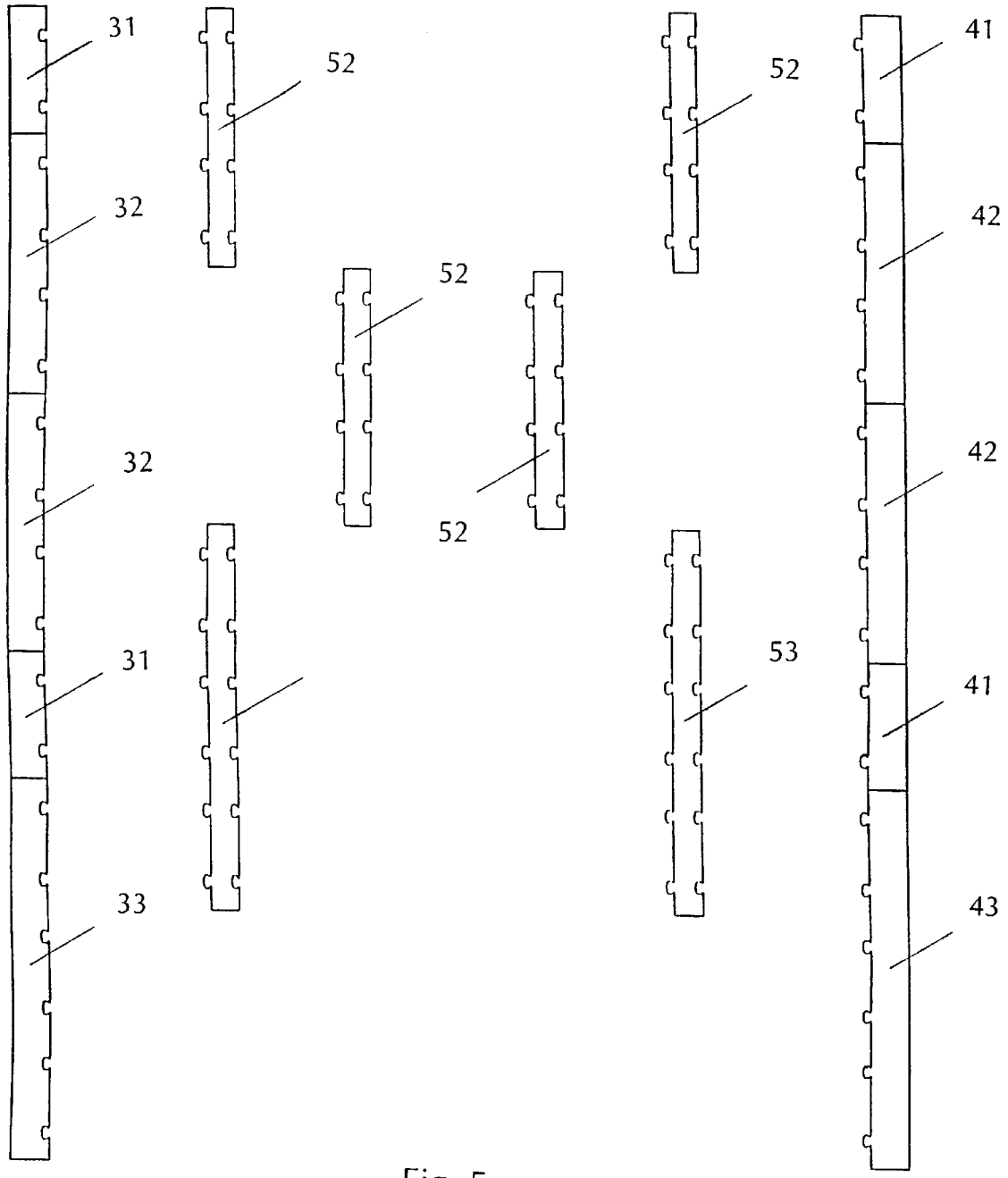
FIG. 5 is a reproduction of FIG. 4 with interior grid character pieces removed.

FIG. 5 is a reproduction of FIG. 4 with all of the alphanumeric interior grid character pieces removed, leaving only the frame structure pieces of this form of the invention including endpieces (31,32,33 and 41,42,43) and connector pieces (52 and 53) exactly as described for FIG. 4.

Figure 6:
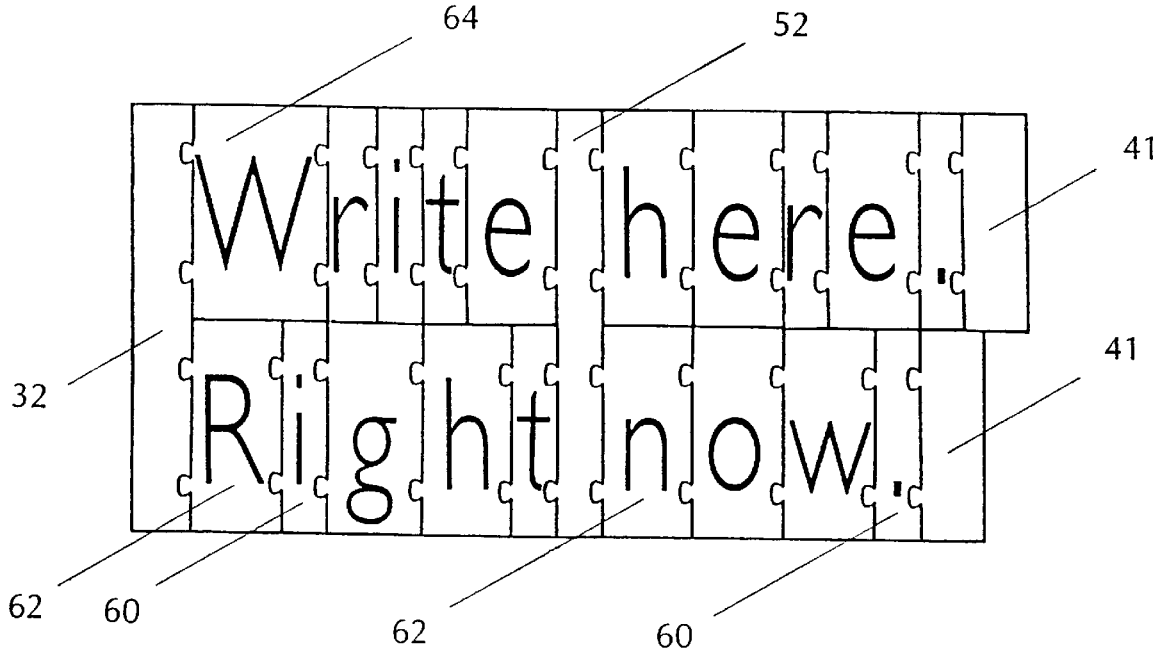
FIG. 6 is a user constructed grid of pieces from the resource grid shown in FIG. 4.

FIG. 6 is an example of a user constructed grid from the elements of the resource grid shown in FIG. 4. The user has integrated two rectangular perimeter constructions utilizing a left side end piece (32) which serves to connect and square the interlocked interior grid character pieces of the first line with the interior grid pieces of the second line. A connector piece (52) is utilized both to create a space between words in each line and to further connect and support the two line construction. Two single line right hand endpieces (41) are used to square the right edges of the two integrated constructions. The mathematical relatonship between the width of the connector pieces (52) and the widths of the narrow character pieces (60) and of the next width character pieces (62) and of the greater width character pieces (64) of the example is shown to comprise an exact, working, functionable system for interconnection of pieces maintaining the special accomodation for the difference in widths of characters.

The foregoing description of preferred embodiments of this invention is intended as illustrative. The concept and scope of the invention are limited only by the following claims and obvious variations thereof.

What is claimed is:

1. A changeable display system of pieces adapted to fit in orthogonal, interconnected rows; said pieces having opposing sides and edges, said edges including a left edge, a right edge, a top edge and a bottom edge, some of said pieces forming a grid having a perimeter edge, said perimeter edge having a parallelogram shape, and interior pieces having substantially horizontal and vertical axes which define the dimensions of the pieces, said interior pieces selectively used to create another desired arrangement of pieces; and upon which are carried alphanumeric characters or symbols which can be positioned to create words or number strings, said alphanumeric characters having different widths, or which are blank, to be used to create a space between words or to build a larger blank space as desired by the user; and which can be positioned on any one of the edges of any other interior piece, each interior piece having a width dimension that is a multiple of a single, select width dimension there being interior pieces of at least two different width dimensions, to maintain a consistent amount of blank space surrounding each alphanumeric character;

the interior pieces including a system of complimentary tabs and indentations at the left and right edges of the pieces; and having top and bottom edges which are non-interlocking, straight, parallel lines; said system of pieces forming a grid including a system of endpieces wherein said endpieces have interlocking edges to connect with interior pieces and straight edges to complete the parallelogram shape of the perimeter edge desired to surround one or more rows of interior pieces with alphanumeric characters and blanks, where a row of interior pieces can be connected to another row of interior pieces or to a row of connector pieces; said connector pieces designed to interconnect with interior pieces employing the system of complimentary tabs and indentations and having a width dimension that is some multiple of the single, select width dimension from which the width dimension of the interior pieces is derived so as to maintain the matching of construction dimensions required to interconnect pieces at regular intervals of construction width.

2. A changeable display system of pieces as described in claim 1 whose perimeter edges on the left or right side of the endpieces have a repeating design which is other than a straight line.

3. A changeable display system of pieces as described in claim 1 whose noninterlocking edges on the top and the bottom of interior pieces, connector pieces, and endpieces have a repeating design which is other than a straight line.

4. A changeable display system of pieces as described in claim 1 whose interlocking edges on the left and/or right sides of the pieces have a repeating design (beyond the tabs and indentations) which is other than a straight line.

5. A changeable display system of pieces as described in claim 1 in which some of the interior pieces, connector pieces, and endpieces are imprinted with an entire word, wordstring, numberstring, or the images of objects other than a single alphanumeric character.

6. A changeable display system of pieces as described in claim 1 in which the construction design is employed for use as a jigsaw puzzle design and any visual image is imprinted on or affixed to the display surface.

7. A sign construction kit including:

a. a plurality of individual sign pieces;

b. each sign piece being a relatively flat, thin structure having a perimeter and opposing sides;

c. one of said opposing sides of each sign piece being designed for attachment to a surface on which a sign is to be constructed and the other of said opposing sides of each sign piece having indicia imprinted thereon, said indicia being selected from the group consisting of alphabetic letters, numbers, symbols and blanks;

d. each indicia being assigned a width, with each width being relatively a multiple of a basic select width dimension and there being at least two different widths assigned;

e. each sign piece having a width with the width of the sign pieces being a multiple of said basic select width dimension and there being at least two different widths of sign pieces;

f. the indicia on each sign piece being selected such that the assigned width of said indicia matches the relative corresponding width dimension of said sign piece;

g. the perimeter of said sign pieces including a top, a bottom and opposing ends with the opposing ends, and only the opposing ends, of said sign pieces including tabs and indentations whereby each of said sign pieces can be attached to an adjacent sign piece; and h. a series of border pieces having tabs and indentations wherein said border pieces can be connected to secure rows of said sign pieces within a frame.

8. The sign construction kit of claim 7 further including at least one blank sign piece having a length sufficient to extend between two rows of attached sign pieces.

9. The sign construction kit of claim 7 wherein the sign pieces on which indicia is imprinted are all of a height equal to each other.

10. The sign construction kit of claim 9 wherein some of the blank sign pieces are of a height equal to twice the height of the sign pieces on which indicia is imprinted.

11. The sign construction kit of claim 7 wherein the tops of the sign pieces are straight lines.

12. The sign construction kit of claim 7 wherein the bottoms of the sign pieces are straight lines.

13. The sign construction kit of claim 12 wherein the tops of the sign pieces are straight lines.

14. The sign construction kit of claim 7 wherein some of the blank sign pieces include tabs and indentations on one of said opposing ends and not on the other opposing end for use in constructing a border around a sign made with said sign pieces.

15. The sign construction kit of claim 7 wherein the one of said opposing sides of each sign piece is magnetized.

* * * * *